US008347458B2

(12) United States Patent
Tseng et al.

(10) Patent No.: US 8,347,458 B2
(45) Date of Patent: Jan. 8, 2013

(54) BYPASS-TYPE MOTOR PROTECTING DEVICE FOR A VACUUM CLEANER

(75) Inventors: Shui-Chun Tseng, Taichung Hsien (TW); Chin-Chao Chung, Taichung Hsien (TW); Ming-Da Li, Taichung Hsien (TW)

(73) Assignee: Zeng Hsing Industrial Co., Ltd. (TW)

( * ) Notice: Subject to any disclaimer, the term of this patent is extended or adjusted under 35 U.S.C. 154(b) by 821 days.

(21) Appl. No.: 12/538,813

(22) Filed: Aug. 10, 2009

(65) Prior Publication Data

US 2011/0033289 A1 Feb. 10, 2011

(51) Int. Cl.

| | |
|---|---|
| ***A47L 9/02*** | (2006.01) |
| ***F16K 15/00*** | (2006.01) |
| ***F16K 17/00*** | (2006.01) |
| ***F16K 21/04*** | (2006.01) |
| ***F01L 3/10*** | (2006.01) |

(52) U.S. Cl. ..... 15/421; 137/540; 137/543.19; 137/543.21; 251/337

(58) Field of Classification Search ..... 15/421; 137/526, 524, 540–543.23; 251/337
See application file for complete search history.

(56) References Cited

U.S. PATENT DOCUMENTS

| | | | | | |
|---|---|---|---|---|---|
| 2,080,760 | A * | 5/1937 | Condon | 137/524 |
| 2,275,472 | A * | 3/1942 | Samiran | 137/255 |
| 2,367,989 | A * | 1/1945 | Alders | 137/514.3 |
| 2,395,941 | A * | 3/1946 | Rockwell | 137/115.15 |
| 2,449,683 | A * | 9/1948 | Akerman et al. | 137/543.21 |
| 2,481,018 | A * | 9/1949 | Johnson | 137/526 |
| 4,129,144 | A * | 12/1978 | Andersson et al. | 137/541 |
| 4,696,320 | A * | 9/1987 | Bull | 137/116.5 |
| 7,628,169 | B2 * | 12/2009 | Choate et al. | 137/469 |

* cited by examiner

*Primary Examiner* — Bryan R Muller
(74) *Attorney, Agent, or Firm* — The Mueller Law Office, P.C.

(57) ABSTRACT

A bypass-type motor protecting device includes: a casing fitted into a bypass opening in a body housing of a vacuum cleaner and having an inner abutment wall; a seat body having a bypass entry port; a valve body unit movable within the casing relative to the bypass entry port and including a valve disc to be engaged with and disengaged from the seat body, a plunger body having an externally accessible operated head and an axially extending threaded shank, and an abutment member threadedly engaged with the shank such that rotation of the operated head results in a change of an axial distance between the abutment member and the inner abutment wall; and a biasing member disposed to bias the abutment member and the inner abutment wall such that a biasing force thereof is varied in strength by the change of the axial distance.

5 Claims, 6 Drawing Sheets

BYPASS-TYPE MOTOR PROTECTING DEVICE FOR A VACUUM CLEANER

BACKGROUND OF THE INVENTION

1. Field of the Invention

This invention relates to a vacuum cleaner, more particularly to a bypass-type motor protecting device for a vacuum cleaner.

2. Description of the Related Art

A conventional vacuum cleaner generally includes a bypass-type motor protecting device mounted upstream of a motor intake port such that, once a hose is clogged, the protecting device can be opened to permit flow of cool ambient air into a body housing of the cleaner over a suction motor.

Referring to FIG. 1, a conventional bypass-type motor protecting device is shown to include a casing 2 secured to a body housing 1 of a vacuum cleaner, a seat body 3 secured to the casing 2, a valve body 4 disposed to be movable in the casing 2, and a biasing member 5 disposed between the casing 2 and the valve body 4. The casing 2 has a tubular wall 202 which defines a passageway 201, and an inner abutment wall 204 which defines an internal port 203 that communicates the passageway 201 with an airflow duct 101 of the body housing 1. The seat body 3 extends radially to close an open end of the passageway 201, and defines a bypass entry port 301 communicating the passageway 201 with ambient air. The valve body 4 has a valve disc 401 which is movable to be engaged with or disengaged from the seat body 3. The biasing member 5 is disposed to bias the valve disc 401 to enable the valve disc 401 to be engaged with the seat body 3 so as to close the bypass entry port 301. Once a suction opening of the vacuum cleaner is clogged by the trapped dust, the valve disc 401 is moved and is caused to be disengaged from the valve seat 3 by ambient air pressure due to generation in the airflow duct 101 of a back pressure smaller than the ambient air pressure, so that external air is permitted to enter into the airflow duct 101.

The strength of the biasing force of the biasing member 5 must be precise, and must be measured in order to provide a good motor protecting effect without compromising the suction effect of the vacuum cleaner. However, no adjusting means is provided in the conventional bypass-type motor protecting device for adjusting the biasing force of the biasing member in a convenient and precise manner.

SUMMARY OF THE INVENTION

The object of the present invention is to provide a bypass-type motor protecting device for a vacuum cleaner which can simplify the adjusting operation of the strength of the biasing force of a biasing member to permit convenient and precise level adjustment.

According to this invention, the bypass-type motor protecting device includes a casing, a seat body, a valve body unit, and a biasing member. The casing has a tubular wall which includes a mounting end that defines an access bore, and that is adapted to be fitted into a bypass opening of a body housing of a vacuum cleaner, and which surrounds an axis and extends along the axis and inwardly to define a passageway therein. The casing further has an inner abutment wall which extends radially to confront the passageway, and which has an internal port that is adapted to communicate the passageway with an airflow duct in the body housing. The seat body extends radially to close the access bore, and has an inner peripheral wall which defines a bypass entry port that is in fluid communication with the passageway. A back pressure is generated in the bypass entry port as a result of clogging of the airflow duct by trapped dust. The valve body unit is disposed to be movable in the passageway between a closed position, where entry of air into the passageway through the bypass entry port is denied, and an open position, where, by virtue of the back pressure generated in the airflow duct, air is permitted to enter into the passageway through the bypass entry port. The valve body unit includes a valve disc, a plunger body, and an abutment member. The valve disc is configured to be engaged with and disengaged from the seat body when the valve body unit is in the closed and open positions, respectively. The plunger body has an operated head which is disposed to be externally accessible through the bypass entry port, and which is mounted on the valve disc to be revolvable about the axis, and a threaded shank which extends from the operated head along the axis into the passageway. The abutment member is spaced apart from the inner abutment wall along the axis by an axial distance, and which is threadedly engaged with the threaded shank such that rotation of the operated head about the axis results in the change of the axial distance. The biasing member abuts against the inner abutment wall and the abutment member to provide a biasing force to bias the valve disc to the closed position. The biasing force is varied in strength by the change of the axial distance.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
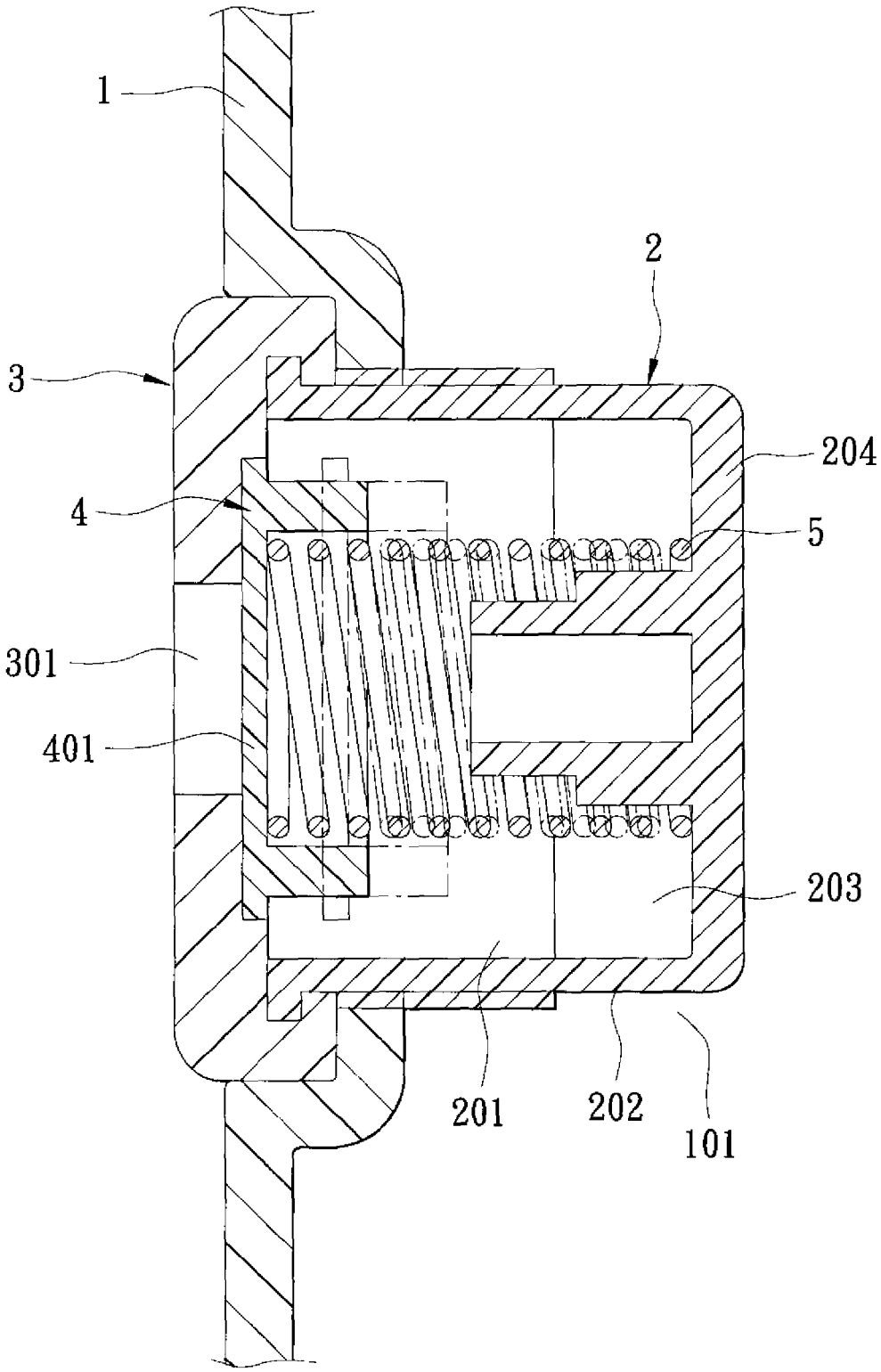
FIG. 1 PRIOR ART
FIG. 1 is a fragmentary sectional view of a conventional bypass-type motor protecting device for a vacuum cleaner.
Figure 2:
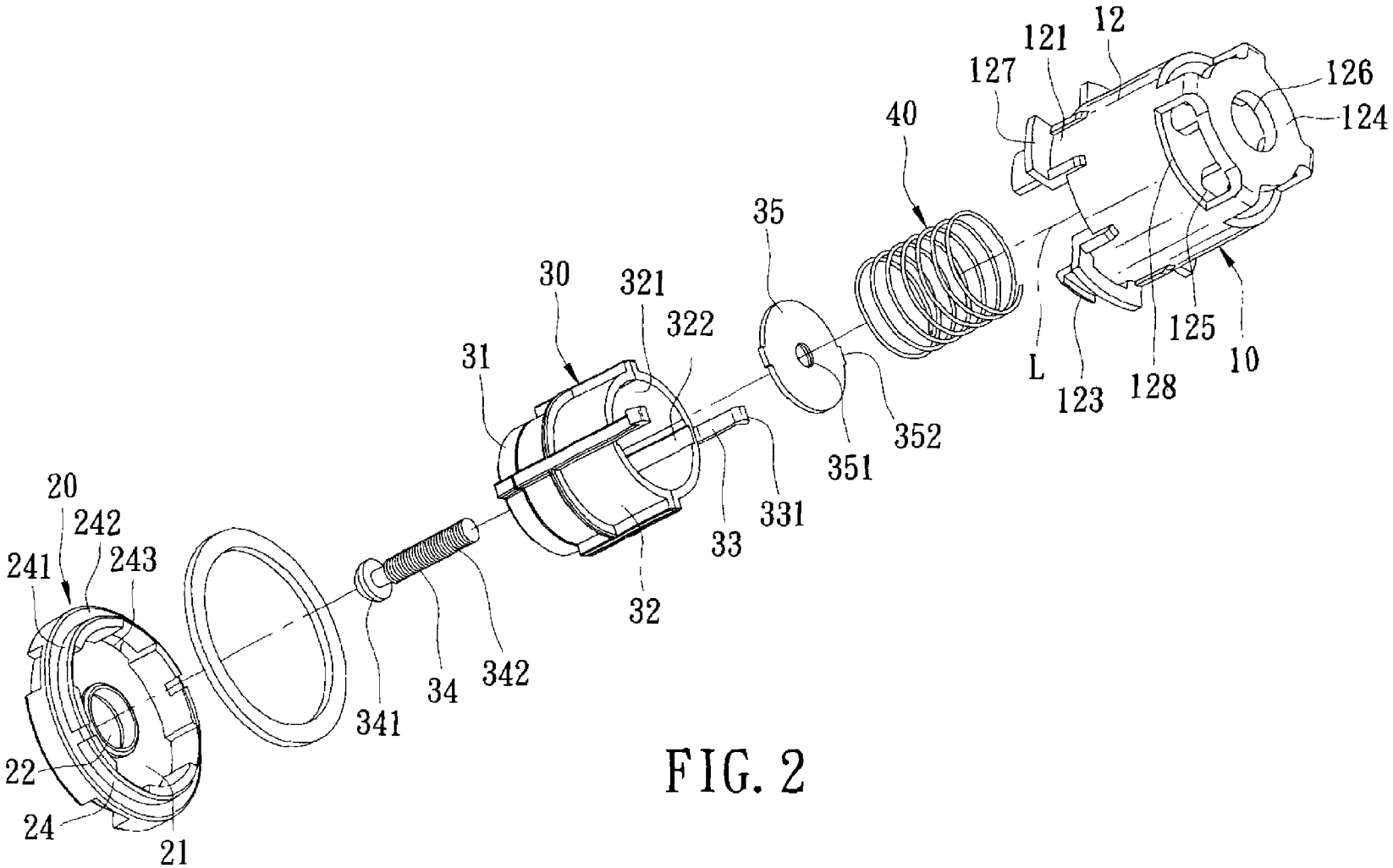
FIG. 2 is an exploded perspective view of the preferred embodiment of a bypass-type motor protecting device for a vacuum cleaner according to this invention.
Figure 3:
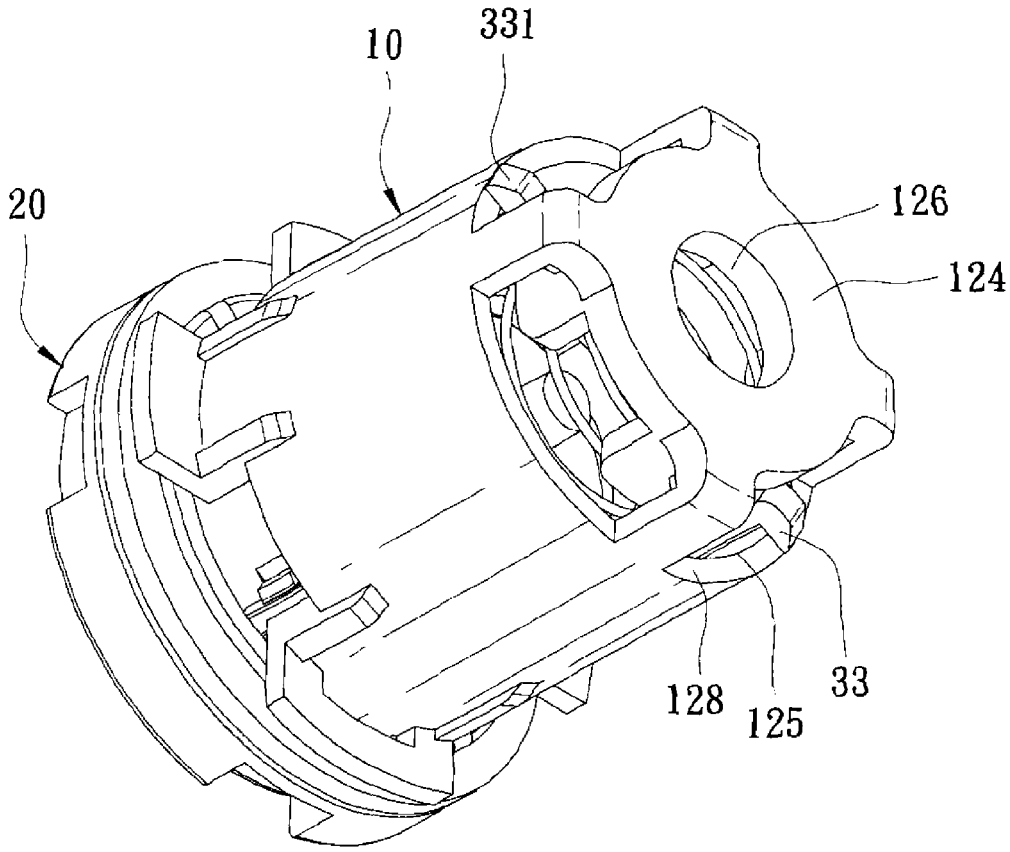
FIG. 3 is a perspective view of the preferred embodiment.
Figure 4:
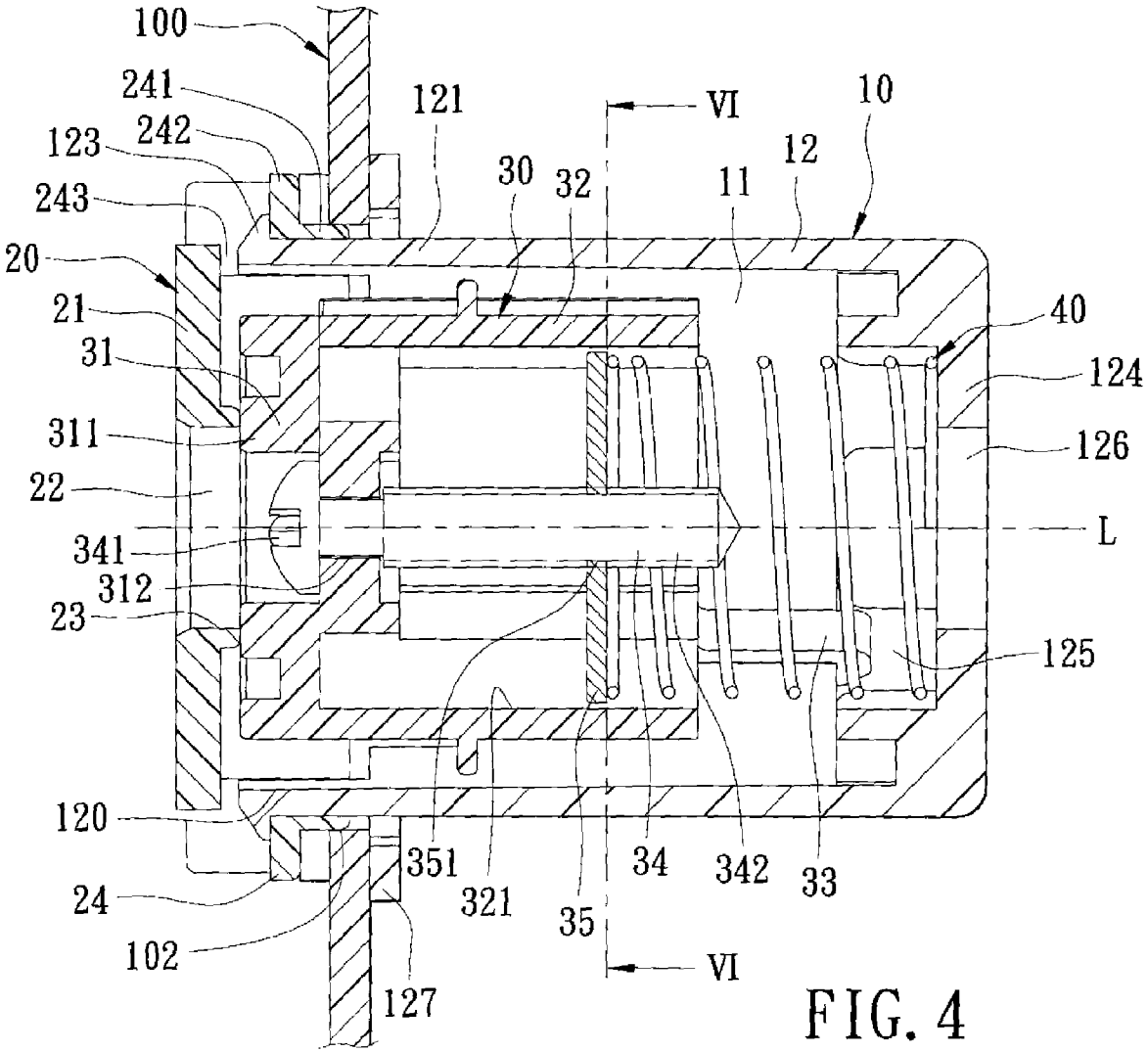
FIG. 4 is a sectional view of the preferred embodiment in a closed state.

Referring to FIGS. 2 to 4, the preferred embodiment of a bypass-type motor protecting device for a vacuum cleaner according to the present invention is shown to be mounted in a bypass opening 102 in a body housing 100 of the vacuum cleaner. The body housing 100 generally has an intake port (not shown), an airflow duct (not shown) which is disposed within the body housing 100 and which is in fluid communication with the intake port, a filter unit (not shown) disposed in the airflow duct for trapping dust, a suction motor (not shown) disposed in the airflow duct and downstream of the filter unit, and a hose (not shown) which is in fluid communication with the intake port, and which has a suction opening remote from the intake port for sucking up a dust-entraining air stream. The bypass-type motor protecting device comprises a casing 10, an end cap 20, a valve body unit 30, and a biasing member 40.

The casing 10 has a tubular wall 12 which includes a mounting end 121 defining an access bore 120, and which surrounds an axis (L) and extends along the axis (L) and inwardly to define a passageway 11 that is communicated with the access bore 120. The casing 10 further has a plurality of retaining protrusions 123 and a plurality of abutment portions 127 extending radially from the mounting end 121, and an inner abutment wall 124 which extends radially to confront the passageway 11, and which has an internal port 126 that is adapted to communicate the passageway 11 with the airflow duct. The tubular wall 12 further has a plurality of through holes 125 disposed adjacent to the inner abutment wall 124 and angularly displaced from one another about the axis (L) for facilitating fluid communication between the passageway 11 and the airflow duct.

The end cap 20 includes a seat body 21 extending radially to close the access bore 120, and having an inner peripheral wall 23 which defines a bypass entry port 22 that is in fluid communication with the passageway 11. A back pressure is generated at the bypass entry port 22 as a result of clogging of the airflow duct by trapped dust, thereby creating a reduced pressure upstream of the suction motor. The end cap 20 further includes a flange member 24 which has an angularly extending insert 241 that extends along the axis (L), and that is configured to be inserted together with the mounting end 121 into the bypass opening 102 so as to enable the mounting end 121 to be fitted into the bypass opening 102, and a flange portion 242 that extends radially and outwardly from the angularly extending insert 241, and that is spaced apart from the seat body 21 axially and radially so as to form a surrounding gap 243. Thus, during assembly of the protecting device onto the body housing 100 of the vacuum cleaner, the casing 10 is inserted into the body housing 100 through the bypass opening 102 to permit the abutment portions 127 to abut against an inner wall of the body housing 100, and the end cap 20 is mounted on the casing 10 to permit the retaining protrusions 123 to extend outwardly through the surrounding gap 243 and rest on the flange portion 242. Subsequently, the insert 241 is fitted into the bypass opening 102 together with the mounting end 121, thereby securing the seat body 21 to the body housing 100.

Figure 5:
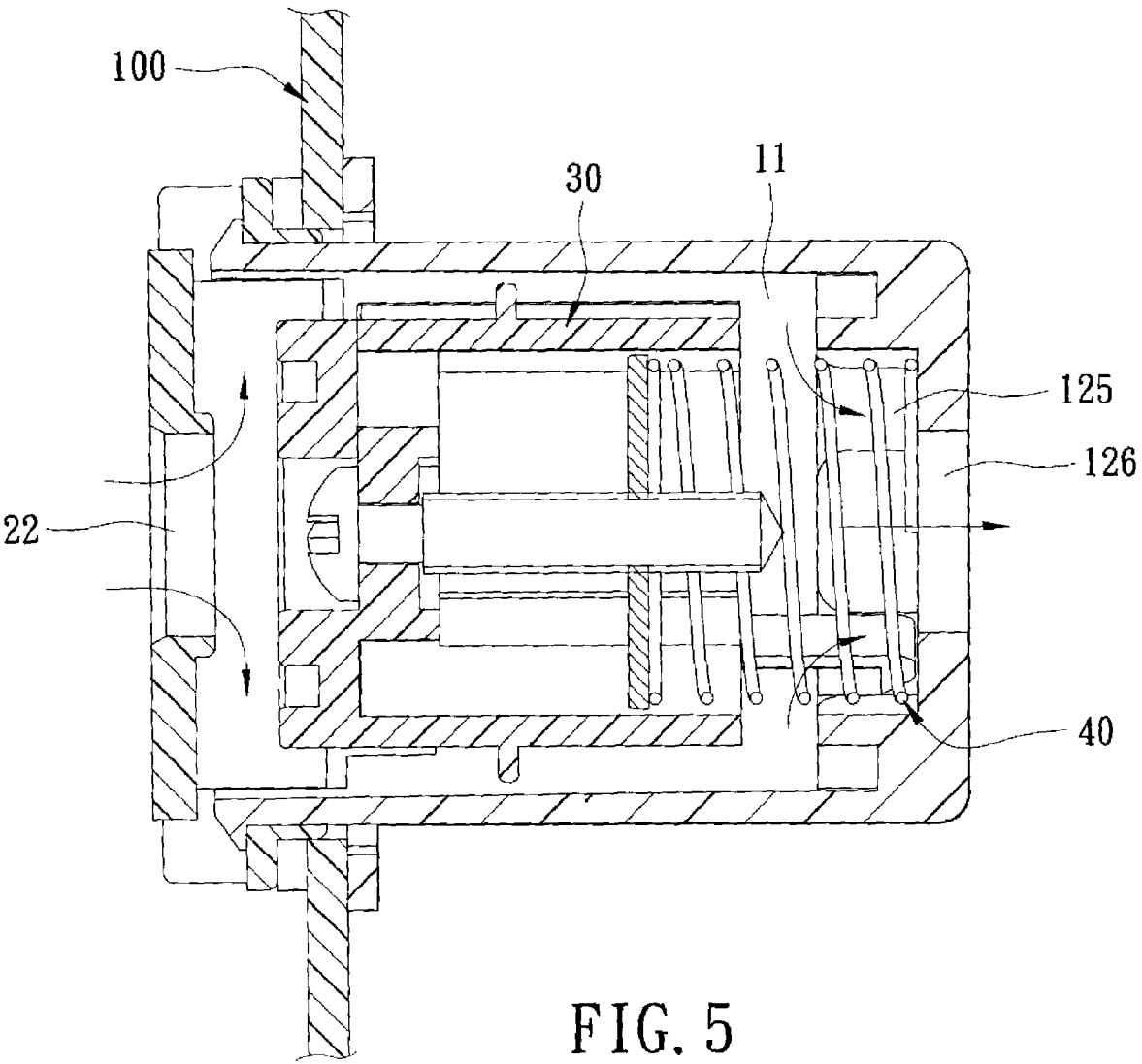
FIG. 5 is a sectional view of the preferred embodiment in an open state.
Figure 6:
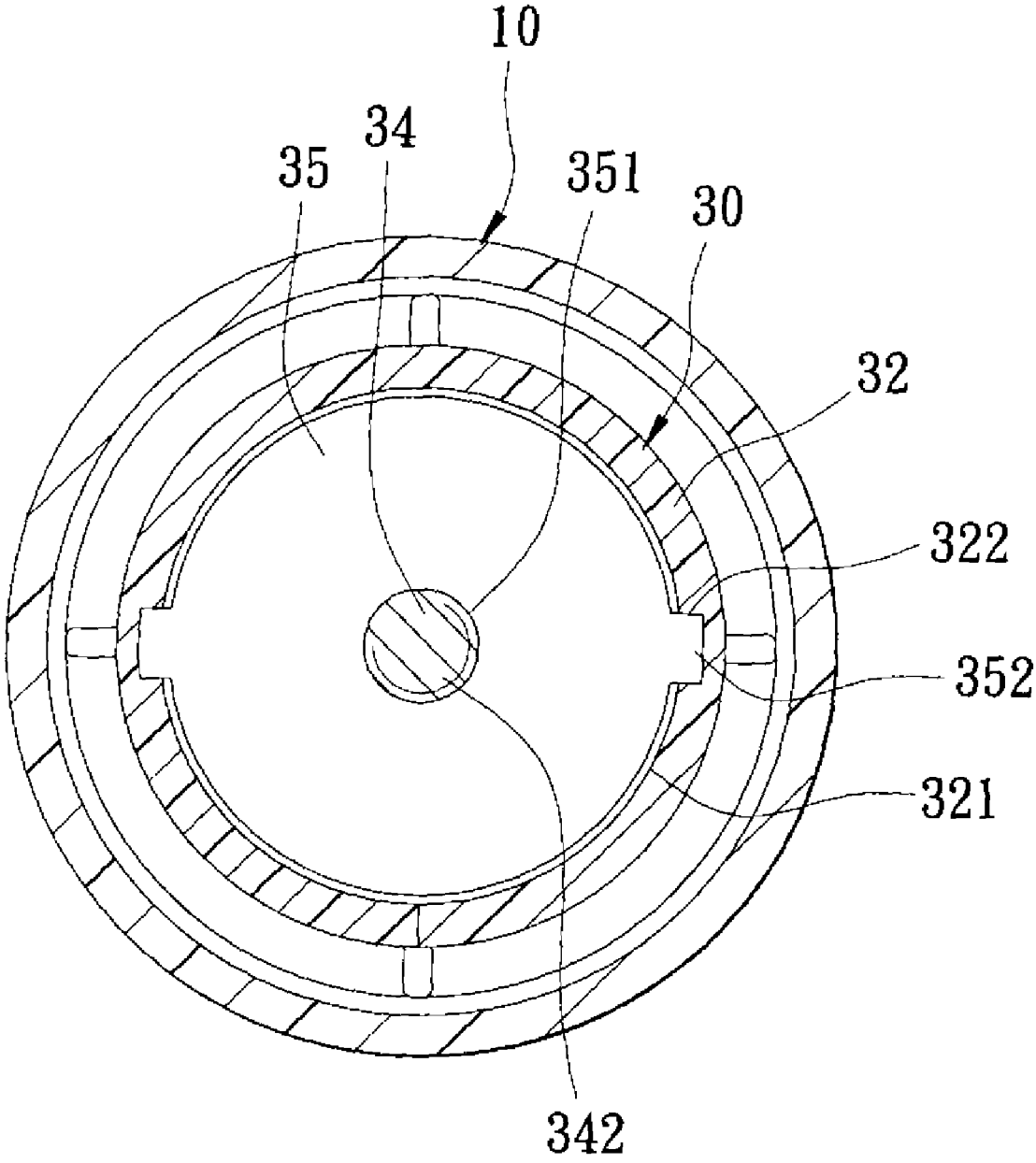
FIG. 6 is a cross-sectional view of a valve body unit taken along lines VI-VI of FIG. 4.

The valve body unit 30 is disposed to be movable in the passageway 11 between a closed position, as shown in FIG. 4, where entry of air into the passageway 11 through the bypass entry port 22 is denied, and an open position, as shown in FIG. 5, where, by virtue of the back pressure generated at the bypass entry port 22, air is permitted to flow into the passageway 11 through the bypass entry port 22. Specifically, the valve body unit 30 includes a valve disc 31, a confining wall 32, a plunger body 34, and an abutment member 35. The valve disc 31 is configured to be engaged with and disengaged from the seat body 21 when the valve body unit 30 is in the closed and open positions, respectively. The confining wall 32 extends from the valve disc 31 along the axis (L), and has an inner wall surface 321 which has a plurality of guiding grooves 322 extending axially, as shown in FIG. 6. The plunger body 34 has an operated head 341 which is disposed to be externally accessible through the bypass entry port 22, and which is mounted on the valve disc 31 through an axial hole 312 to be revolvable about the axis (L), and a threaded shank 342 which extends from the operated head 341 along the axis (L) within the confining wall 32. The abutment member 35 is in the form of an annular disc, and has a screw hole 351 threadedly engaged with the threaded shank 342, and a plurality of keys 352 configured to be in spline engagement with the guiding grooves 322 (as shown in FIG. 6). The abutment member 35 is spaced apart from the inner abutment wall 124 along the axis (L) by an axial distance. Thus, rotation of the operated head 341 about the axis (L) results in displacement of the abutment member 35 along the axis (L) to change the axial distance.

Preferably, the valve body unit 30 includes a plurality of guided members 33 which are disposed on the confining wall 32 and each of which extends axially to terminate at a stop end 331. Each of the through holes 125 in the tubular wall 12 of the casing 10 is configured to extend axially and towards the mounting end 121, and terminates at a barrier end 128 which guards against further movement of the stop end 331 in the closed position so as to minimize impact of the valve disc 31 on the seat body 21 when the valve body unit 30 is brought to the closed position. Moreover, the guided members 33 are slidably and respectively mounted in the through holes 125 to guide the movement of the valve body unit 30 along the axis (L).

The biasing member 40 has two ends respectively abutting against the inner abutment wall 124 and the abutment member 35 to provide a biasing force to bias the valve disc 31 to the closed position.

As shown in FIG. 5, once the suction opening of the hose of the vacuum cleaner is undesirably clogged, a back pressure is generated in the airflow duct, thereby creating a reduced pressure upstream of the suction motor. The reduced pressure urges the valve disc 31 to disengage from the seat body 21 so as to move the valve body unit 30 to the open position. At this stage, cool ambient air is permitted to enter into the passageway 11 and the airflow duct so as to dissipate heat around the suction motor to thereby prevent overheating of the suction motor.

With the bypass-type motor protecting device of the present invention, the operation of adjusting the strength of the biasing force of the biasing member 40 can be simplified to permit a convenient and precise level adjustment. Specifically, by rotating the operated head 341 with a tool bit to change the axial distance between the abutment member 35 and the inner abutment wall 124, the strength of the biasing force of the biasing member 40 can be varied. The adjusting operation can be conducted conveniently and precisely after the manufacture and assembly operations are completed without the need to remove any component parts from the vacuum cleaner and change the biasing member.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

We claim:

1. A bypass-type motor protecting device for a vacuum cleaner, the vacuum cleaner including a body housing which has an intake port, an airflow duct which is disposed within the body housing and which is in fluid communication with the intake port, a filter unit disposed in the airflow duct for trapping dust, a suction motor disposed in the airflow duct and downstream of the filter unit, and a hose which is in fluid communication with the intake port, and which has a suction opening remote from said intake port for sucking up a dust-entraining air stream, the body housing further having a bypass opening, said bypass-type motor protecting device comprising:

a casing having a tubular wall which includes a mounting end that defines an access bore, and that is adapted to be fitted into the bypass opening, and which surrounds an axis and extends along the axis and inwardly to define a passageway that is communicated with said access bore, said casing further having an inner abutment wall which extends radially to confront said passageway, and which has an internal port that is adapted to communicate said passageway with the airflow duct;

a seat body extending radially to close said access bore, and having an inner peripheral wall which defines a bypass entry port that is in fluid communication with said passageway, a back pressure being generated at said bypass entry port as a result of clogging of the airflow duct by the trapped dust, thereby creating a reduced pressure upstream of the suction motor;

a valve body unit which is disposed to be movable in said passageway between a closed position, where said valve body unit covers said bypass entry port and denies entry of air into said passageway through said bypass entry port, and an open position, where, by virtue of the generated back pressure, air is permitted to enter into said passageway through said bypass entry port, and which includes to a valve disc configured to be engaged with and disengaged from said seat body when said valve body unit is in the closed and open positions, respectively, a plunger body having an operated head which is disposed to be externally accessible through said bypass entry port, and which is mounted on said valve disc to be revolvable about the axis, and a threaded shank which extends from said operated head along the axis into said passageway, and an abutment member which is spaced apart from said inner abutment wall along the axis by an axial distance, and which is threadedly engaged with said threaded shank such that rotation of said operated head about the axis results in a change of the axial distance; and a biasing member which has two ends respectively abutting against said inner abutment wall and said abutment member to provide a biasing force to bias said valve disc to the closed position such that the biasing force is varied in strength by the change of the axial distance.

2. The bypass-type motor protecting device according to claim 1, wherein said valve body unit includes a confining wall which extends from said valve disc along the axis and which has an inner wall surface that is in spline engagement with said abutment member so as to permit displacement of said abutment member along the axis to result in the change of the axial distance by the rotation of said operated head about the axis.

3. The bypass-type motor protecting device according to claim 2, wherein said tubular wall of said casing has a plurality of through holes disposed adjacent to said inner abutment wall and angularly displaced from one another about the axis for facilitating fluid communication between said passageway and the airflow duct.

4. The bypass-type motor protecting device according to claim 3, wherein said valve body unit includes a plurality of guided members which are disposed on said confining wall and which extend parallel to the axis to terminate at a stop end, each of said through holes being configured to extend along the axis and towards said mounting end and terminating at a barrier end which guards against further movement of said stop end in the closed position so as to minimize impact of said valve disc on said seat body when said valve body unit is brought to the closed position.

5. The bypass-type motor protecting device according to claim 1, wherein said casing has a plurality of retaining protrusions which extend radially from said mounting end, said bypass-type motor protecting device further comprising a flange member which includes an angularly extending insert that extends along the axis, and that is configured to be inserted together with said mounting end into the bypass opening so as to enable said mounting end to be fitted into the bypass opening, and a flange portion that extends radially and outwardly from said angularly extending insert so as to permit said retaining protrusions to rest on said flange portion, that is formed with said seat body, and that is spaced apart from said seat body axially and radially to form a surrounding gap, said retaining protrusions extending outwardly through said surrounding gap to rest on said flange portion so as to secure said seat body to the body housing.

* * * * *